United States Patent [19]

Wirth

[11] Patent Number: 4,741,719

[45] Date of Patent: May 3, 1988

[54] GARMENT WITH BREAST SUPPORTS

[75] Inventor: Cynthia Wirth, Westwood, Calif.

[73] Assignee: Reebok International Ltd., Canton, Mass.

[21] Appl. No.: 921,298

[22] Filed: Oct. 21, 1986

[51] Int. Cl.[4] ..... A41C 3/02

[52] U.S. Cl. ..... 450/30; 450/31; 450/58; 450/79; 450/85

[58] Field of Search ..... 128/509, 510, 431, 432, 128/335, 436, 437, 447, 455, 454; 2/67; 450/1, 58, 85, 30, 31, 32, 33, 34, 77, 78, 79

[56] References Cited

U.S. PATENT DOCUMENTS

| | | | |
|---|---|---|---|
| 1,575,989 | 3/1926 | Haven | 450/58 |
| 1,923,821 | 8/1933 | Gudeman | 450/85 |
| 2,372,855 | 4/1945 | Reid | 128/509 |
| 2,402,835 | 6/1946 | Nary | 128/509 |
| 2,479,416 | 8/1949 | Schnurer | 450/30 |
| 2,585,257 | 2/1952 | Lee | 128/509 |
| 4,325,378 | 4/1982 | Wilkinson | 450/58 X |
| 4,444,191 | 4/1984 | Harned | 128/482 |
| 4,607,640 | 8/1986 | McCusker | 128/425 |

*Primary Examiner*—Louis K. Rimrodt
*Attorney, Agent, or Firm*—Frederick Gotha

[57] ABSTRACT

A garment is set forth which includes an outer flexible skin to cover at least the torso and stretchable breast supports beneath the outer skin to overlay the breasts. Tendons are attached to the breast supports and are adjustably pulled to stretch the supports over the breasts to press, hold and support the breasts against the body.

9 Claims, 8 Drawing Sheets

14b
14a
40
32b
32a
20b
20a
26a
26b
18
34
10
22
24

GARMENT WITH BREAST SUPPORTS

FIELD OF THE INVENTION

This invention relates to garments, and more particularly, relates to garments which support the breasts particularly during exercise.

BACKGROUND OF THE INVENTION

To provide comfort for women during activities including dance, aerobics, jogging or the like, breast supports are desirable. For this purpose, bras and particularly sports bras have been devised to support the breasts to restrain movement thereof. Use of sport bras can be precluded by the styling or nature of the fabric of the outerwear which may expose the bra causing an unsightly appearance. Further, the sports bras typically are designed for a particular cup sizes and are not infinitely adjustable and, therefore, may not provide the desired support and optimum comfort for all women.

SUMMARY OF THE INVENTION

There is, therefore, provided according to the present invention a garment which does not require a sports bra and which provides for infinite adjustment to maximize the breast support and comfort and hence the utility of the garment.

Toward this end, the garment includes a stretchable fabric outer skin adapted to fit snuggly over at least the torso, hips and buttocks of the body. The stretchable nature of the fabric skin enables said skin to snuggly conform the body and to stretch to accommodate flexure of the body. If desired, the fabric skin may be fashionably styled with leg openings. Alternatively, the garment may be provided with legs of the same stretchable fabric skin to snuggly cover the legs and accommodate flexure thereof. A pair of breast supports are defined within the skin by stretchable or elastomeric fabric secured to the skin, the supports interposed the outer skin and breasts.

A tendon is secured to each breast support for stretching each support toward each other across the breast to adjustably press, hold and support the breasts against the body. The tendons are adapted to be tied together to prevent relax of the supports and retain their adjusted, interposed relationship.

In one embodiment, the supports are defined by a stretchable liner adapted to encircle the body about the rib cage, the liner portion having a pair of segments projecting to define the supports. The tendons are attached to the segments for pull flexure thereof. In another embodiment the tendons are attached to the outer skin, portions of the tendons defining the breast supports. In this fashion, the tendons crisscross at the front of the body to pull and stretch said tendon portions between the outer skin and breasts to thereby hold the breasts against the body.

As can be appreciated, the garment according to the present invention, is inexpensive to manufacture, is stylish and provides infinite adjustability as to the support for the breasts. By pulling the tendons until the desired support is obtained and tying or otherwise fastening the tendons, the wearer can provide maximum, minimum or medium support for the breasts as desired. The simple construction of the garment which includes the outer skin and breast supports contributes to the inexpensive nature of the garment.

BRIEF DESCRIPTION OF THE DRAWINGS

These and other features and advantages will become appreciated as the same becomes better understood with reference to the following specification, claims and drawings wherein:

DETAILED DESCRIPTION

Figure 1:
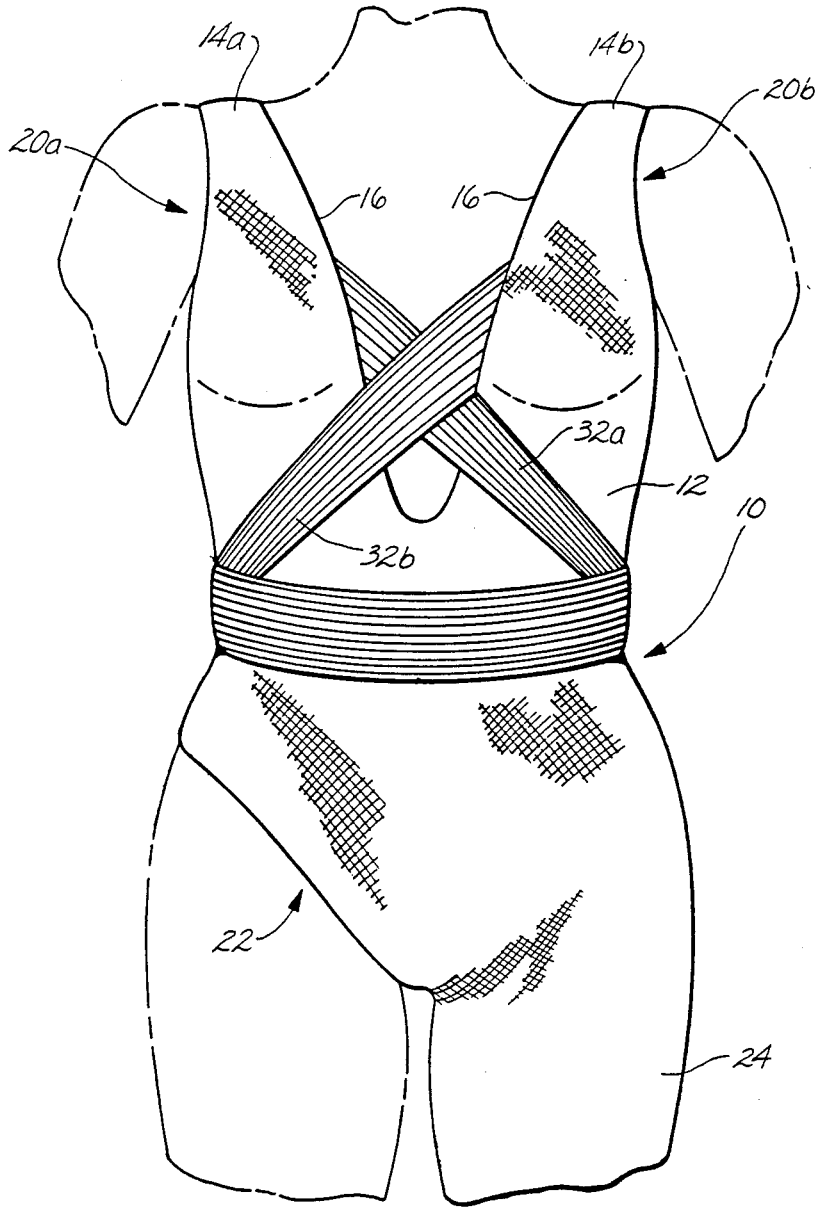
FIG. 1 is a front illustration of one embodiment of the garment according to the present invention.
Figure 2:
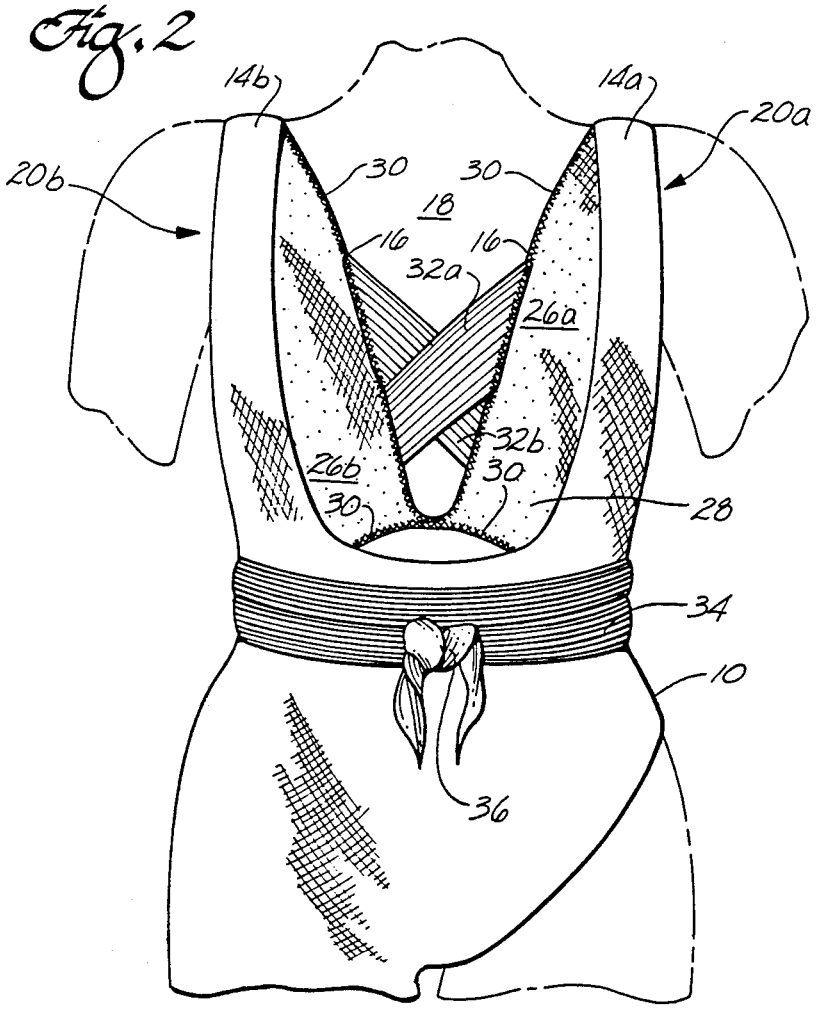
FIG. 2 is a rear view of the garment illustrated in FIG. 1.
Figure 3:
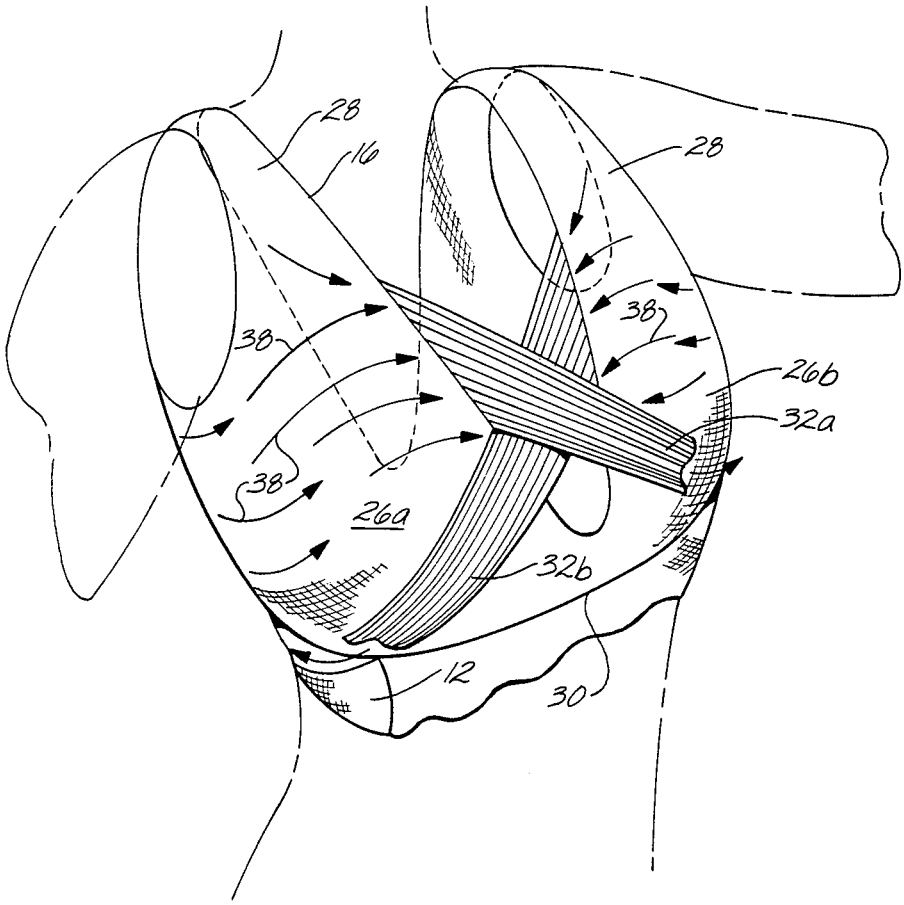
FIG. 3 is a perspective side illustration of the breast supports and tendons of the garment of FIGS. 1 and 2 and the flexure thereof to support the breasts.

Turning to FIGS. 1–3, one embodiment of a garment 10 according to the present invention is illustrated as worn on the body. The garment 10 is fashioned from an outer, stretchable skin 12 which is cut, sown and fashioned to cover the torso, waist, pelvis and buttocks of the body and to have shoulder straps 14*a*, 14*b*. From the shoulder straps 14*a*, 14*b* the garment has a plunging neckline 16 which terminates, for example, proximate a position superposed over the base of the sternum. Opposite the neckline and with reference to FIG. 2, the shoulder straps 14*a*, 14*b* fashionably merge to the remainder of the garment 10 to define a back opening 18. Arm holes 20*a*, 20*b* accommodate the arms. If desired, the garment 10 can have leg openings 22 (only one shown in the drawings) to accommodate the legs or the outer fabric skin 12 may be continued to define legs 24 (only one shown in the drawings) for the garment 10.

The stretchable fabric defining the skin may be of any suitable type preferably of the type which can absorb perspiration, is somewhat porous to allow the body covered by the garment 10 to breath therethrough and is launderable. One type of fabric which has been found suitable is nylon.

To put garment 10 on, the user merely steps through the leg openings 22 or into legs 24 pulling the garment 10 up and inserting her arms through the arm holes 20*a*, 20*b*. The outer skin 12 stretches to fit snuggly against the body and permit flexure thereof.

To provide for support of the breasts and comfort, the garment 10 includes breast supports 26*a*, 26*b* (FIGS. 2 and 3) which according to the embodiment illustrated in FIGS. 1–3 are defined as a portion of a stretchable liner 28 attached to the underside of the skin 12 to encircle the rib cage and follow the contour as defined by neckline 16, shoulder straps 14*a*, 14*b* and back opening 18. As illustrated in FIG. 2, the liner 28 is stitched to skin 12 as by in FIG. 2, the liner 28 is stitched to skin 12 as by stitching 30.

The breast supports 26*a*, 26*b* of liner 28 are separated as defined by neckline 16. To provide for stretching of the liner 28, and more particularly the breast supports 26*a*, 26*b*, the liner 28 may be fashioned from lycra or other suitable fabric to prevent irritation of the skin.

Line 28 may be less elastic than the skin 12, if desired. By the stretchable nature of the skin 12 and liner 28 and the operation of the garment 10 as hereinafter set forth, liner 28 need not be contoured or shaped in the form of cups to accommodate the breasts.

To infinitely adjust the garment 10 to hold and support the breasts, tendons 32*a*, 32*b* are attached at one end thereof to breast supports 26*a*, 26*b* at neckline 16 as by stitching 30. Tendons 32*a*, 32*b* may be embodied as stretchable sashes fashioned from the same material as the skin 12 and may be color coordinated therewith. Further, tendons 32*a*, 32*b* may have substantial width at the neckline 16 to proximate, for example, the vertical dimension of the average breast. The width of tendons 32*a*, 32*b* may decrease as dictated by fashion and tendons 32*a*, 32*b* preferably have a length to wrap about the waist in the manner indicated in the drawings to define a belt 34. Ends of the tendons 32*a*, 32*b* opposite those attached to breast supports 26*a*, 26*b* may thereafter be tied together as by knot 36 or connected by any suitable fastening means.

When garment 10 is initially put on, tendons 32*a*, 32*b* are loose and breast supports 26*a*, 26*b* by their stretchable nature provide a minimum support for the breasts. To adjust the support, tendons 32*a*, 32*b* are pulled in a crisscross fashion as indicated in FIG. 3 stretching breast supports 26*a*, 26*b* toward each other, the skin 12 accommodating such stretching, such flexure of the breast supports 26*a*, 26*b* pressing against the breasts to hold and support the same against the body. The elastic deformation (stretching) is indicated by arrows 38 in FIG. 3. When the desired support is obtained, tendons 32*a*, 32*b* are wrapped once or several times about the waist to define the belt 34 and are fastened as by knot 36 to prevent the elastically deformed breast supports 26*a*, 26*b* from relaxing. As adjusted, skin 12 snuggly fits over the body and liner 28 and the breast supports 26*a*, 26*b* firmly hold and support the breasts during exercise or other activity. Further, as indicated in FIG. 1, tendons 32*a*, 32*b* pass beneath the breast adding support thereto.

Figure 4:
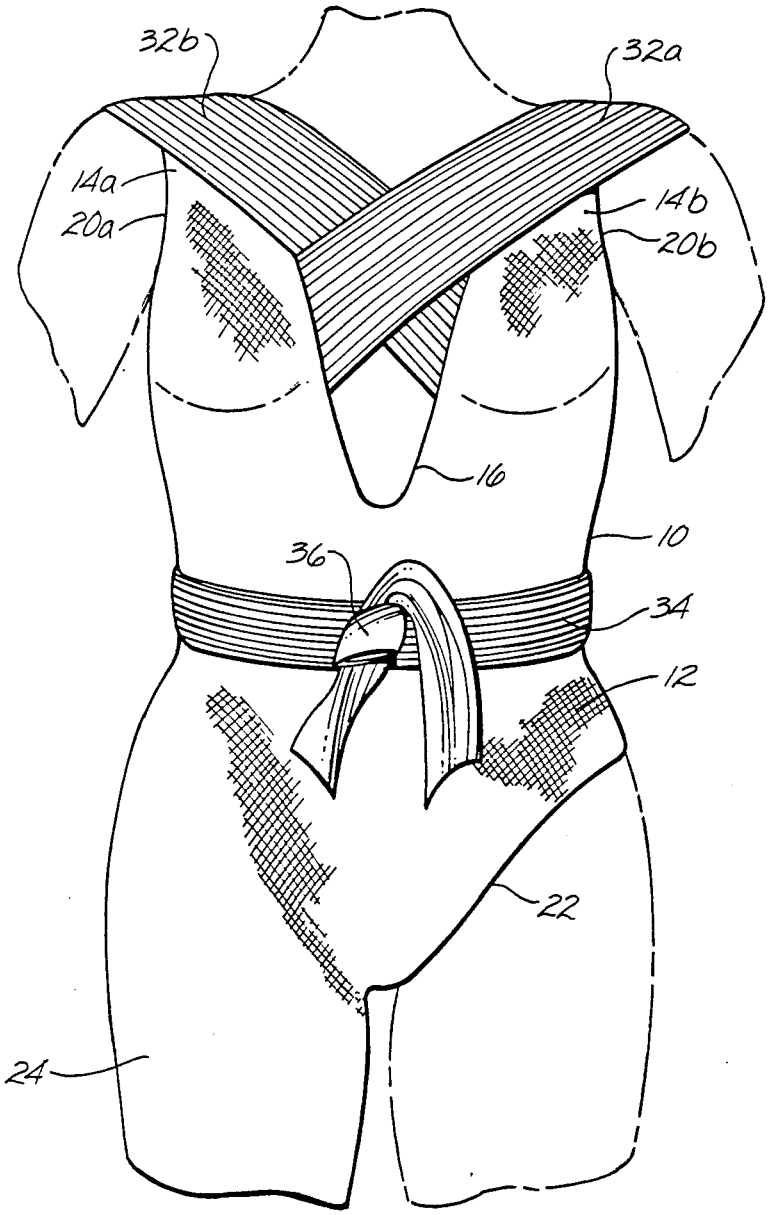
FIG. 4 is a front view of another embodiment of a garment according to the present invention.
Figure 5:
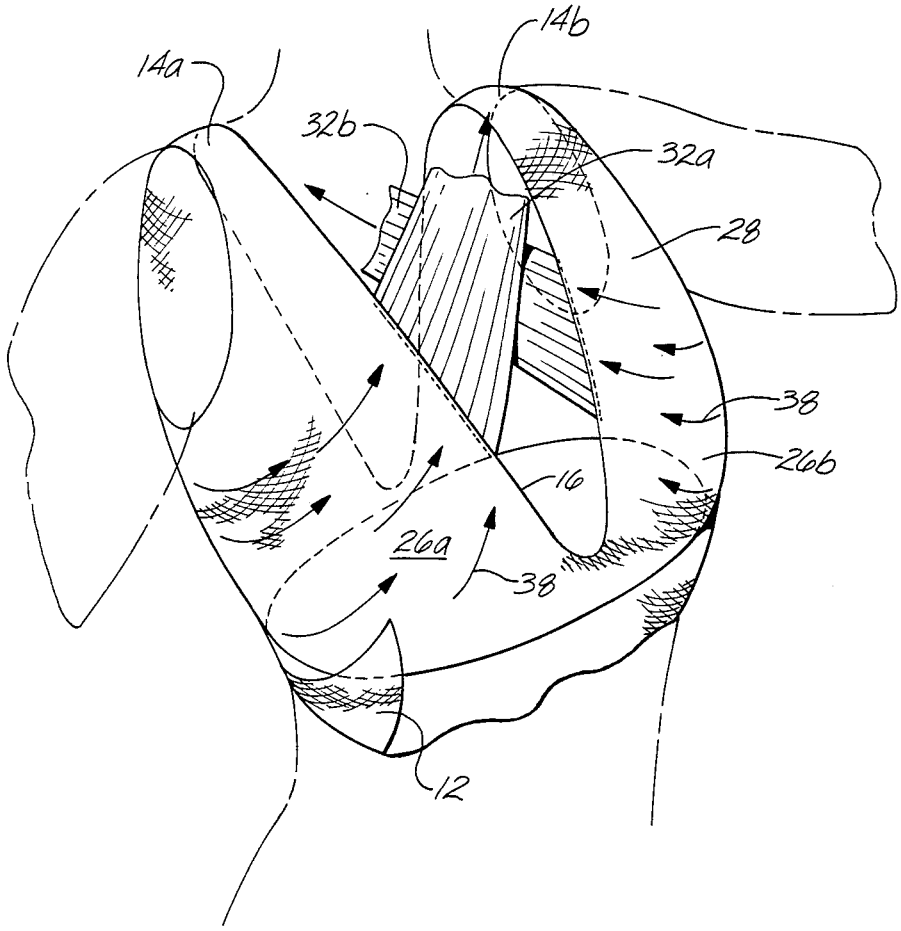
FIG. 5 is a perspective side illustration of the garment of FIG. 5 illustrating the breast supports and flexure thereof.

With reference to FIG. 4 a variant of the garment 10 of FIGS. 1–3 is illustrated. According to this embodiment, tendons 32*a*, 32*b* instead of directed beneath the breasts are pulled over the shoulders, crisscross at the back and thereafter wrapped about the waist to define belt 34. Tendons 32*a*, 32*b* are interconnected at the front as by knot 36. As illustrated in FIG. 5, when tendons 32*a*, 32*b* are pulled, breast supports 36*a*, 36*b* stretch in the direction of arrows 38 about the rib cage and angularly upward toward the sternum to stretch breast supports 26*a*, 26*b* across the breasts to hold and support the same.

Figure 6:
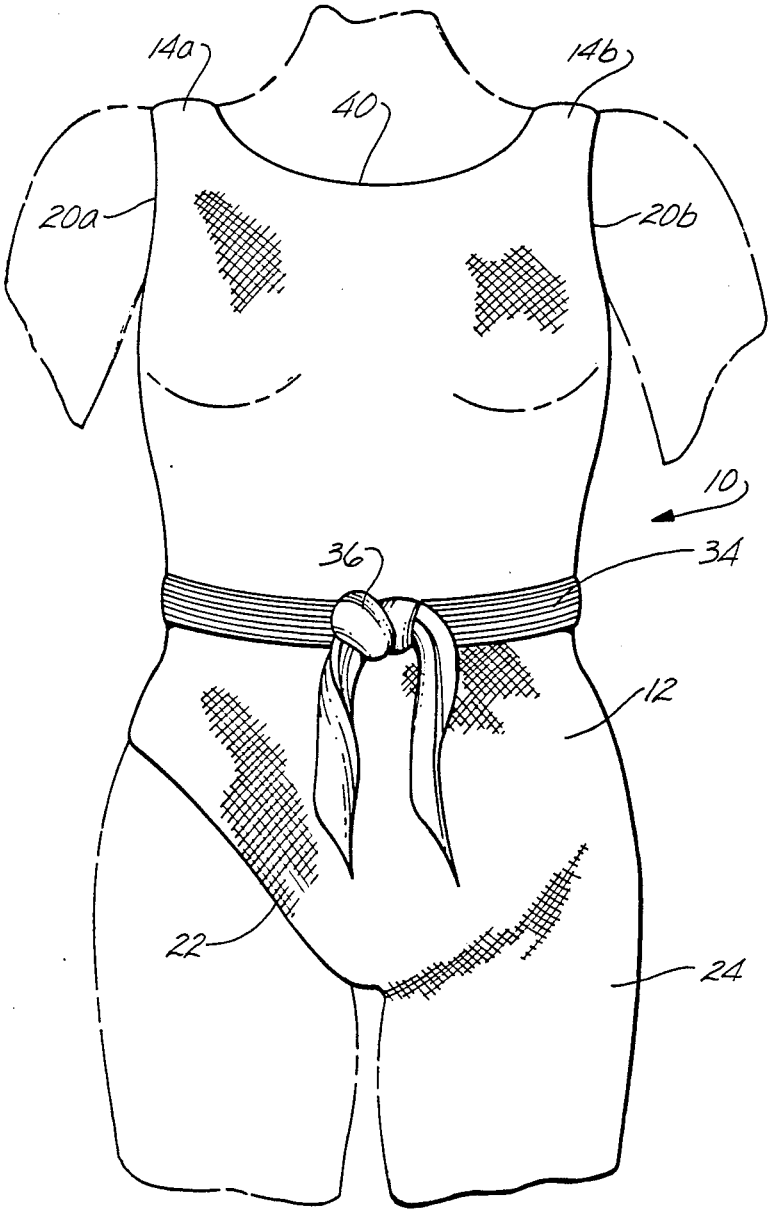
FIG. 6 is a front view of still another embodiment of the garment according to the present invention.
Figure 7:
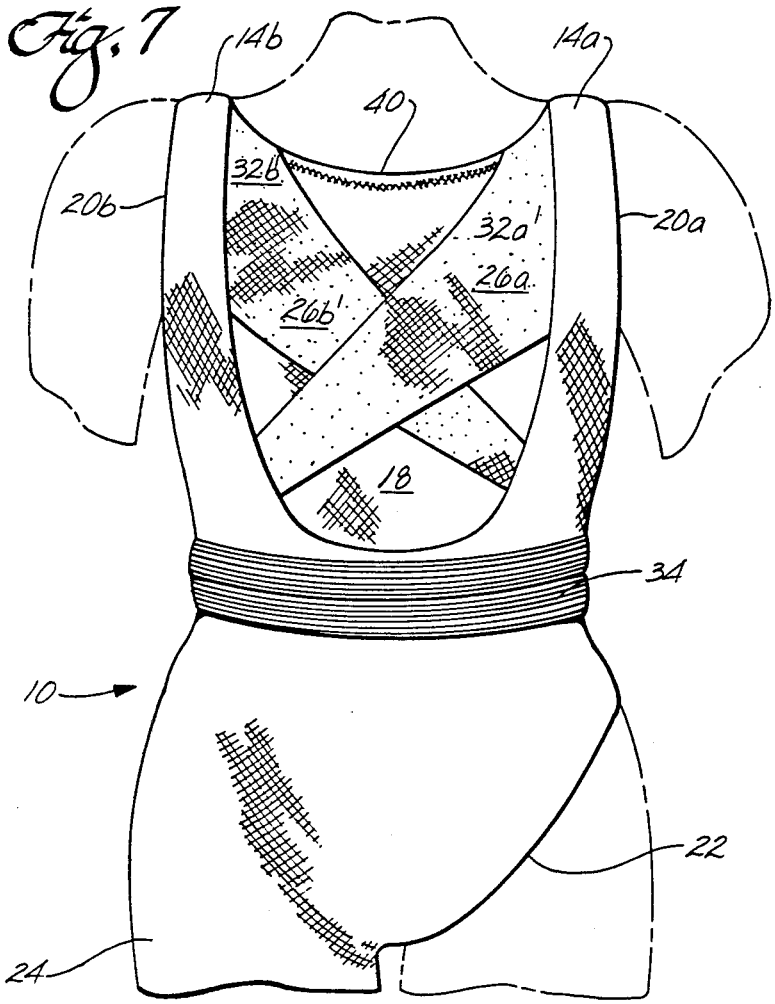
FIG. 7 is a rear view of the garment of FIG. 6.
Figure 8:
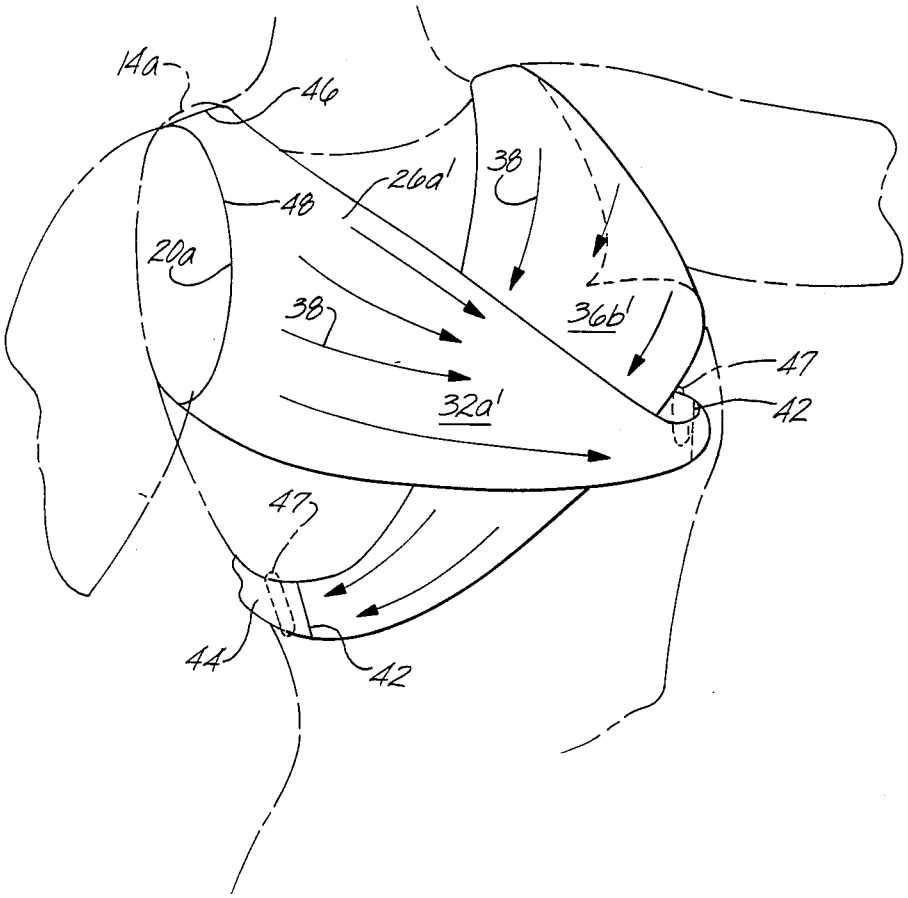
FIG. 8 is a side perspective illustration of the breast supports for the garment of FIGS. 6 and 7.

With reference to FIGS. 6–8, another embodiment of the garment according to the present invention is shown. According to this embodiment, garment 10 has the skin 12 fashioned to define a somewhat crew collar 40 and shoulder straps 14*a*, 14*b*. Arm holes 20*a*, 20*b* are provided as are leg openings 22 or full legs 24 as described in detail above. At the back, and with reference to FIG. 7, skin 12 defines back opening 18 for the garment 10. According to this embodiment, the liner described in detail above with reference to the preceding embodiments is not provided. In lieu thereof, tendons 32*a*′ and 32*b* ′ are provided within skin 12 superposed over the chest and breasts under the outer skin 12 as indicated in FIGS. 7 and 8. In that tendons 32*a*′, 32*b*′ are identical, only one will be described in detail.

Tendon 32*a*′ is fashioned to have at least a portion defining a breast support 26*a*′. Breast support 26*a*′ is defined by that portion of tendon 32*a*′ which extends from arm hole 20*a* across the chest to have a terminus at the side of the body as defined by stitching 42 which attaches breast support 26*a*′ to a belt portion 44. Breast support 26*a*′ is configured at one end to be attached to shoulder strap 14*a* as by stitching 46, follow the contour of arm hole 20*a* and terminate at the bottom thereof in the region of the armpit. Stitching 48 attaches breast support 26*a*′ to the outer skin at arm hole 20*a*. Breast support 26*a*′ from arm hole 20*a* extends downwardly and across the chest to be interposed outer skin 12 and breast to terminate at stitching 42. Belt portion 44 constituting the remainder of tension 32*a*′ from breast support 26*a*′ extends from within skin 12 through a side opening 47 to define the outer belt 34 for garment 10. With reference to tendon 32*b*′, it is attached in a similar manner to the skin 12 at shoulder strap 14*b* and arm hole 20*b* to extend, as shown in FIG. 8, forwardly and downwardly across the breast passing beneath tendon 32*a*′ and outwardly from the skin 12 through side opening 47.

Garment 10 according to FIGS. 6–8 is worn and put on in the manner described above and as shown in the drawings. When initially put on, breast supports 26*a*′, 26*b*′ provide little or no support for the breasts above the stretchable nature of skin 12. To adjust the garment 10 to hold and support the breasts, tendons 32*a*, 32*b* are pulled from side openings 46 thereby stretching the respective portions defining breast supports 26*a*′, 26*b*′ in the direction of arrows 38 (FIG. 8) to thereby draw said breast supports 26*a*′, 26*b*′ across the body to press, hold and support the breasts thereagainst particularly during physical activity.

Then the desired support is obtained, tendons 32*a*′, 32*b*′ are connected at a knot 36 to prevent relax of the stretched supports.

When it is desired to remove the garment, the tendons are loosened and the garment is slipped off.

While I have shown and described certain embodiments of the present invention, it is to be understood that it is subject to many modifications without departing from the spirit and scope of the claims as recited herein. For example, the tendons may be connected or otherwise fixed by a belt buckle, Velcro-type connectors, clips or the like.

What is claimed is:

1. A garment comprising:

a stretchable fabric outer skin adapted to fit snuggly over at least the torso including the chest;

stretchable fabric disposed beneath the outer skin and so mounted and cojoined thereto to define a pair of breast supports; and a tendon attached to each support for stretching said supports toward each other across said breasts to adjustably press and hold the breasts against movement, said tendons adapted to be fixed to prevent relax of said supports.

2. The garment of claim 1 wherein said stretchable fabric disposed beneath said outer skin is an elastomeric liner portion disposed about the rib cage, said liner portion having a pair of segments adapted to be disposed at either side of the sternum and projecting over the breasts to define said supports.

3. The garment of claim 2 wherein said tendons are adapted to cross at the front of the body and wrap about the waist to be tied thereat.

4. The garment of claim 1 where said stretchable fabric disposed beneath said outer skin comprises a pair of elastomeric segments adapted to extend over the breast angularly downwardly from the shoulder of the garment to define said breast supports, said segments crossing at the front of the body beneath said outer skin.

5. The garment of claim 4 wherein said tendons extend between the body and said outer skin and through openings at the sides of the garment.

6. A garment comprising:

stretchable fabric skin adapted to fit snuggly over at least the torso including the chest;

an elastomeric liner attached to the underside of said skin about the chest, said liner including spaced portions projecting over said breasts defining breast supports.

7. The garment of claim 6 wherein said tendons are stretchable.

8. The garment of claim 6 wherein said tendons are of a length to wrap about the waist at least once and to be tied together.

9. A garment comprising:

a stretchable fabric outer skin to cover at least the torso;

a pair of tendons each having a stretchable portion attached to the inside of the outer skin at the shoulder and extending beneath the outer skin angularly downwardly to overlay a breast and define a breast support and a belt portion extending from the breast support through an opening to outside the outer skin, pulling of said tendons stretching each breast support across said breast to adjustably hold and support the same against the body; and means for fixing said tendon belt portions outside said skin against relax of the breasts supports.

* * * * *